US005257852A

United States Patent [19]

Tsuneki et al.

[11] Patent Number: 5,257,852

[45] Date of Patent: Nov. 2, 1993

[54] DAMPER DEVICE FOR AN AUTOMATIC FOLDING CHAIR

[75] Inventors: Ken Tsuneki; Kazuyosh Ohshima; Yojiro Nakayama, all of Tokyo, Japan

[73] Assignees: Sugatsune Industrial Co., Ltd.; Kotobuki Corporation, both of Tokyo, Japan; a part interest

[21] Appl. No.: 909,399

[22] Filed: Jul. 8, 1992

[51] Int. Cl.[5] ..... A47C 1/121

[52] U.S. Cl. ..... 297/332; 188/291; 192/415; 192/58 B; 297/335

[58] Field of Search ..... 297/331, 332, 335, 408; 192/41 S, 58 B; 188/291

[56] References Cited

U.S. PATENT DOCUMENTS

| | | | |
|---|---|---|---|
| 3,335,823 | 8/1967 | Nagel | 188/291 |
| 4,069,545 | 1/1978 | Holet et al. | 188/291 X |
| 5,165,507 | 11/1992 | Ohshima | 188/291 X |
| 5,170,867 | 12/1992 | Ojima et al. | 188/291 |

FOREIGN PATENT DOCUMENTS

| | | | |
|---|---|---|---|
| 2233798 | 1/1975 | France | 297/332 |
| 45784 | 4/1977 | Japan . | |
| 295420 | 8/1928 | United Kingdom | 297/332 |

*Primary Examiner*—Lloyd A. Gall
*Attorney, Agent, or Firm*—Jacobson, Price, Holman & Stern

[57] ABSTRACT

A damper device for an automatic folding chair enables the seat of the chair to be turned downward to a ready-for use position without being subjected to any braking force when it is lightly pushed down. When the use leaves the seat in the ready-for-use position, it automatically and slowly returns to an upright position under a braking effort exerted thereto. Said damper device comprises a power unit 2 and a damper unit 1 for raising the seat E slowly from the ready-for-use position to the upright position, said damper unit 1 comprising a casing 3 that rotates around a fixed shaft 4 of the chair in association with the rising movement of the seat E, a movable sleeve 7 rotatably disposed within said casing 3, viscous fluid C filled in the space between the movable sleeve 7 and the casing 3 and a one-way clutch 10 constituted by a coil spring that functionally couples the movable sleeve 7 and the fixed shaft 4 when the seat E is turned upward by the resilient force of the power unit 2 and releases the functional coupling of the movable sleeve 7 and the fixed shaft 4 when the seat E is turned downward.

3 Claims, 6 Drawing Sheets

DAMPER DEVICE FOR AN AUTOMATIC FOLDING CHAIR

BACKGROUND OF THE INVENTION

This invention relates to a damper device for an automatic folding chair for use in a theater or other public gathering place having a seat rotatably fitted to a fixed shaft of the chair, said device comprising a power unit for storing the resilient force generated in its spring means by rotary movement of the seat from a substantially upright standing position to a substantially horizontal ready-for-use position and a damper unit for damping the returning movement of the seat to the substantially upright position.

FIG. 6 of the accompanying drawings illustrates a known automatic folding mechanism of an automatic folding chair.

Here, an external end of a fixed shaft c is rigidly fitted to a seat supporting member a by means of grub screw b and a seat d is by turn rotatably fitted to said fixed shaft c as the latter is made to pass through a through bore disposed near the lower edge of the seat d. Said fixed shaft c is provided with a rod holder e projecting from the peripheral surface of the shaft for rotatably holding a bent end f' of a rod f, while a seat frame g is provided on an inner lateral surface with a spring-rod holder h projecting inward for holding the other end of said rod f so that the rod f may axially slide through a hole bored in the holder h. A spring j is arranged as seat folding means around the periphery of the rod f and between the spring-rod holder h and a spring holder i on the rod f.

A damper device for an automatic folding chair comprising a power unit and a damper unit of the type under consideration is also already known from Laid Open Japanese Utility Model No. 52-45784. The damper unit of a device according to the above identified document comprises a hollow cylinder for movably holding a shaft and airtightly containing damper liquid to produce a damping effect by the flow resistance of the liquid as it runs though an orifice (a small bore of a piston ring).

With an automatic folding mechanism as described above firstly, the spring j is compressed as the seat d is turned downward in the direction as indicated by arrow k from an upright position to a substantially horizontal ready-for-use position until the torque caused by the weight of the seat comes to exceed the power torque (spring power×rod length) of the spring j at a certain angle of rotation (approximately 80° in most cases) of the seat d so that the seat d is kept to the horizontal position. When, on the other hand, the seat d is slightly turned upward by hand from the horizontal position, it will be automatically turned further upward by the power torque of the spring j until it reaches the upright position.

With such an arrangement, however, since the seat d is accelerated in its upward swinging movement, the chair is subjected to a large impact each time the seat d is turned upward to functionally damage the seat supporting member a and generate a noise. Additionally, since the fixed shaft c and the rod holder e and the seat frame g and the spring-rod holder h need to be rigidly bonded together by welding, manufacture of such folding chairs is inevitably accompanied by a problem of poor efficiency and high cost.

While an automatic folding chair as described above secondly comprises a damper unit to appropriately retard and decelerate the upward rotary movement of the seat from a ready-for-use position to an upright position, the seat also receives a flow resistance of the liquid contained in the cylinder also works when it is turned downward and therefore a considerable effort is required for moving the seat downward. Consequently, the seat cannot be quickly and lightly turned downward from an upright position to a ready-for-use horizontal position.

Besides, since the damper unit comprises a hollow cylinder containing liquid and a shaft running through the cylinder to make the unit rather bulky, it cannot be arranged in the vicinity of the peripheral surface of the rotary shaft that provides a pivot for the seat. The bulkiness of such a damper unit inevitably limits its practical applicability.

Therefore, in view of the drawbacks of the prior art, it is a first object of the present invention to provide a damper device for an automatic folding chair that enables its seat to be lightly pushed down to a ready-for-use position from an upright position without being subjected to a braking force and automatically return to the upright position once the user of the chair leaves the seat.

A second object of the present invention is to provide a damper device for an automatic folding chair having, in addition to the above capabilities, a feature of being applicable to a so-called self-stop type chair having a seat that automatically stops at a ready-for-use position once it is moved downward and a so-called non-stop type chair having a seat that automatically and slowly returns to an upright position once the user of the chair leaves the seat by simply modifying the extent of driving a adjuster screw fitted to its power unit.

A third object of the present invention is to provide a damper device for an automatic folding chair comprising a power unit and a damper unit and having, in addition to the above capability, a feature of being removably fitted to the rotary shaft of a chair by simply passing the shaft through corresponding bores of the device and securing the power unit to the rotary shaft by means of screws so that the damper device may become rotatable with the seat without bonding them together by welding and the overall cost of manufacturing such an automatic folding chair provided with a damper device may be significantly reduced.

SUMMARY OF THE INVENTION

According to a first aspect of the present invention the above first object is achieved by providing a damper device for an automatic folding chair comprising a power unit for storing the resilient force generated in its spring means by rotary movement of the seat from a substantially upright standing position to a substantially horizontal ready-for-use position and a damper unit for damping the returning movement of the seat to the substantially upright position, said damper unit comprising a casing rotatable around a fixed shaft in synchronism with an upward or downward movement of the seat, a movable sleeve rotatably disposed within said casing, viscous fluid filled in the space between said movable sleeve and said casing and a one-way clutch constituted by a coil spring disposed between said movable sleeve and said fixed shaft in such a manner that its diameter is enlarged to release a functional coupling of the movable sleeve and the fixed shaft when the seat is turned downward and reduced to provide a functional coupling of the movable sleeve and the fixed shaft when the seat is turned upward.

According to a second aspect of the present invention, the above second object is achieved by providing a damper device for an automatic folding chair comprising a power unit for storing the resilient force generated in its spring means by rotary movement of the seat from a substantially upright standing position to a substantially horizontal ready-for-use position and a damper unit for damping the returning movement of the seat to the substantially upright position, said damper unit comprising a casing rotatable around a fixed shaft in synchronism with an upward or downward movement of the seat, a movable sleeve rotatably disposed within said casing, viscous fluid filled in the space between said movable sleeve and said casing and a one-way clutch constituted by a coil spring disposed between said movable sleeve and said fixed shaft in such a manner that its diameter is enlarged to release a functional coupling of the movable sleeve and the fixed shaft when the seat is turned downward and reduced to provide a functional coupling of the movable sleeve and the fixed shaft when the seat is turned upward, said power unit comprising a case projecting from the casing of said damper unit perpendicularly to the axis of said casing, a lower sliding spring stop disposed within said case and guided by a guide pin running through a pair of guide slots cut through the oppositely disposed respective lateral side walls so as to be able to move a given stroke, a crank mechanism having an arm with an end pivotally supported by said guide pin and held to said lower sliding spring stop and the other end pivotally supported by an axle of an arm support eccentrically and rigidly fitted to the fixed shaft, an adjuster screw driven through a threaded bore disposed at a top portion of the casing, an upper sliding spring stop capable of being positionally adjusted by said adjuster screw and a spring disposed between said upper sliding spring stop and said lower sliding spring stop to exert a resilient force to the seat to urge it to rotate upward.

According to a third aspect of the present invention, the above third object is achieved by providing a damper device for an automatic folding chair comprising a power unit for storing the resilient force generated in its spring means by rotary movement of the seat from a substantially upright standing position to a substantially horizontal ready-for-use position and a damper unit for damping the returning movement of the seat to the substantially upright position, said damper unit comprising a casing rotatable around a fixed shaft in synchronism with an upward or downward movement of the seat, a movable sleeve rotatably disposed within said casing, viscous fluid filled in the space between said movable sleeve and said casing and a one-way clutch constituted by a coil spring disposed between said movable sleeve and said fixed shaft in such a manner that its diameter is enlarged to release a functional coupling of the movable sleeve and the fixed shaft when the sea is turned downward and reduced to provide a functional coupling of the movable sleeve and the fixed shaft when the seat is turned upward, said power unit comprising a case projecting from the casing of said damper unit perpendicularly to the axis of said casing, a lower sliding spring stop disposed within said case and guided by a guide pin running through a pair of guide slots cut through the oppositely disposed respective lateral side walls so as to be able to move a given stroke, a crank mechanism having an arm with an end pivotally supported by said guide pin and held to said lower sliding spring stop and the other end pivotally supported by an axle of an arm support eccentrically and rigidly fitted to the fixed shaft, an adjuster screw driven through a threaded bore disposed at a top portion of the casing, an upper sliding spring stop capable of being positionally adjusted by said adjuster screw and a spring disposed between said upper sliding spring stop and said lower sliding spring stop to exert a resilient force to the seat to urge it to rotate upward, a ridge and a groove being provided additionally and respectively on the outer surface of the case of said power unit and the seat or vice versa, said ridge and said groove being capable of removably engaged with each other to block any rotary movement relative to each other by relative movement along the axis of the fixed shaft.

With a damper device for an automatic folding chair according to the first aspect of the invention, the one-way clutch comes to be freely movable relative to the fixed shaft as its coil spring is unwound when the seat is rotated downward from an upright position to a ready-for-use position so that the movable sleeve held to the one-way clutch becomes to be freely movable relative to the fixed shaft. Consequently, the casing and the movable sleeve rotate synchronously along with the viscous fluid so that the seat is not subjected to any braking force of the viscous fluid to allow the seat to be smoothly and lightly turned downward.

When the seat is returned to an upright position under the effect of the resilient force of the spring of the power unit, the force is transmitted from the seat to the coil spring of the one-way clutch by way of the casing, the viscous fluid and the movable sleeve to wind up tight the coil spring.

Then, the one-way clutch is firmly held to the fixed shaft to functionally couple the fixed shaft and the movable sleeve and block any rotary movement of the latter so that the casing is subjected to the viscous shearing resistance of the viscous fluid, or a braking force, and therefore the seat is turned upward slowly to its upright position.

With a damper device for an automatic folding chair according to the second aspect of the invention, a chair can be made to a so-called self-stop type chair by adjusting the torque of the coil spring of the power unit for urging the seat to turn upward by means of the adjuster screw to become slightly smaller than the tangential component of the moment of gravity of the seat generated by the dead weight of the seat in its ready-for-use position. When, conversely, the torque of the coil spring is so adjusted by means of the adjuster screw to become greater than the tangential component of the moment of the gravity of the seat, the chair can be made to a so-called non-stop type chair or otherwise the rotary speed of the rising seat can be appropriately adjusted.

With a damper device for an automatic folding chair according to the third aspect of the invention, when the ridge and the groove additionally and respectively disposed on the case of the power unit and the seat or vice versa are made to be engaged with each other after fitting damper unit and the arm support of the power unit to the fixed shaft running through the lateral members of the frame of the seat, the damper device for the automatic folding chair is rigidly secured to the seat so that they may synchronously rotate. As the arm support is secured to the fixed shaft by means of a bolt, the damper device becomes functionally integral with the fixed shaft and the seat. When the both ends of the fixed shaft is secured to the seat support by means of respective grub screws, the automatic folding chair completes its assemblage.

As in the case of the second aspect of the invention, the arm is swung and its upper end is urged to advance in the case of the power unit when the seat is rotated downward from an upright position as the end of the arm is pivotally fitted to the arm support which is by turn rigidly fitted to the fixed shaft. Thus, the spring in the power unit is compressed to store resilient force, which urges the seat to return to the upright position While the casing of the damper unit which is functionally coupled with the case under this condition is rotated with the seat in the same direction, no damping effort is exerted to the seat because the casing and the movable sleeve are also rotated by the one-way clutch as described earlier.

Now, the present invention will be described in greater detail by referring to the accompanying drawings that illustrate preferred embodiments of the invention.

DETAILED DESCRIPTION OF THE INVENTION

Figure 1:
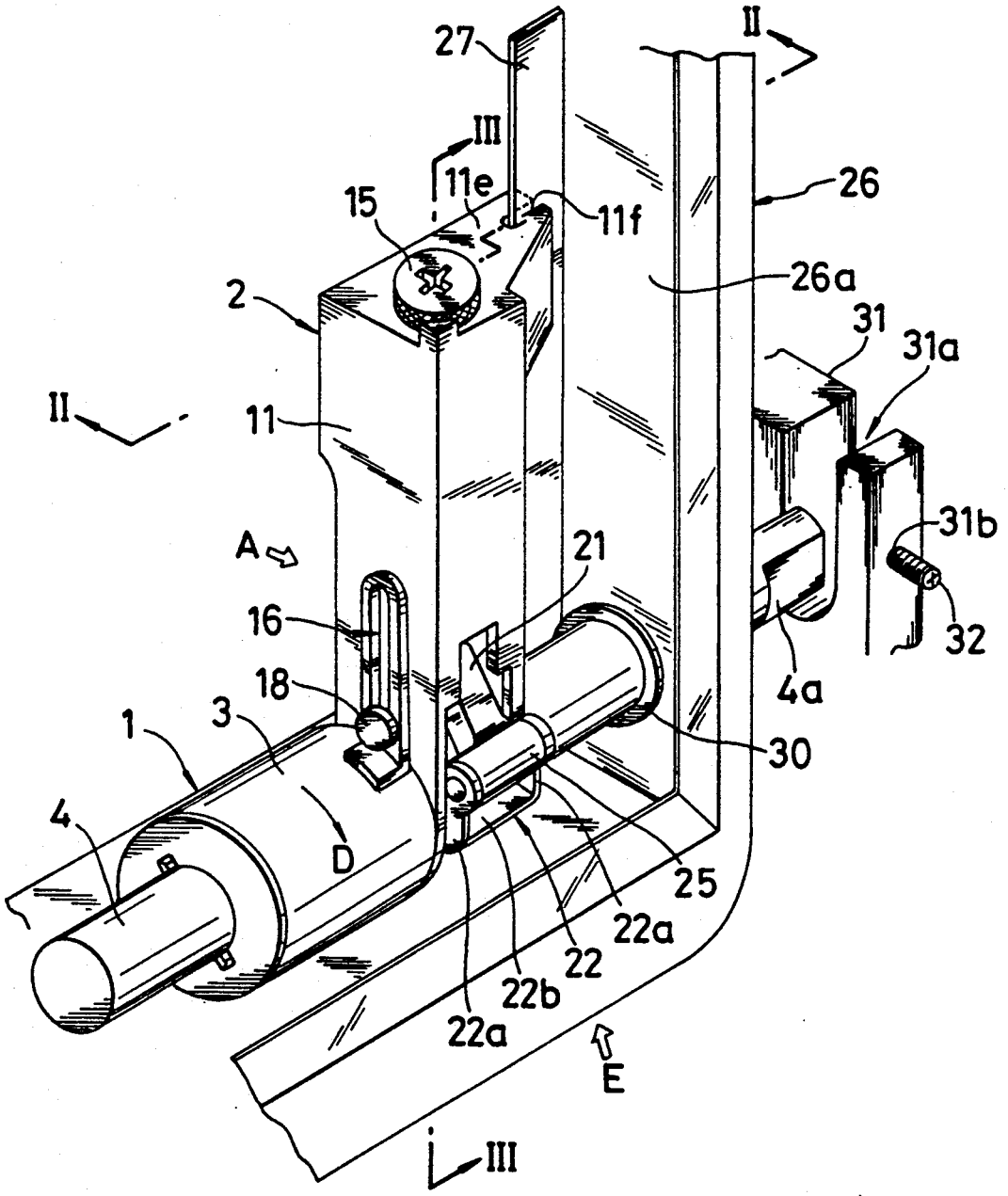
FIG. 1 is a schematic perspective view of first embodiment of a damper device for an automatic folding chair according to the invention, showing only principal components of the device and the chair.

Referring firstly to FIG. 1 showing a first preferred embodiment of the invention, a chair to be used with the embodiment may be that of a known type having arm rests and a back rest and provided with a fixed shaft 4 running horizontally between the lateral members of the frame of the chair and through the seat E of the chair so that the seat E of the chair may be rotated around the fixed shaft 4 from a substantially horizontal ready-for-use position to a substantially upright position or vice versa.

The embodiment of a damper device for an automatic folding chair is designed to be fitted to the underside of the seat E as in the case of similar conventional devices and comprises a damper unit 1 for retarding the rotary speed of the seat E turning from the ready-for-use position to the upright position and a power unit 2 for generating in the device a swing-up torque of a spring for moving the seat E back to its upright position by turning the seat E to the ready-for-use position. In the illustrated embodiment, the damper unit 1 and the power unit 2 are integrally formed to make a damper device A for an automatic folding chair.

Figure 2:
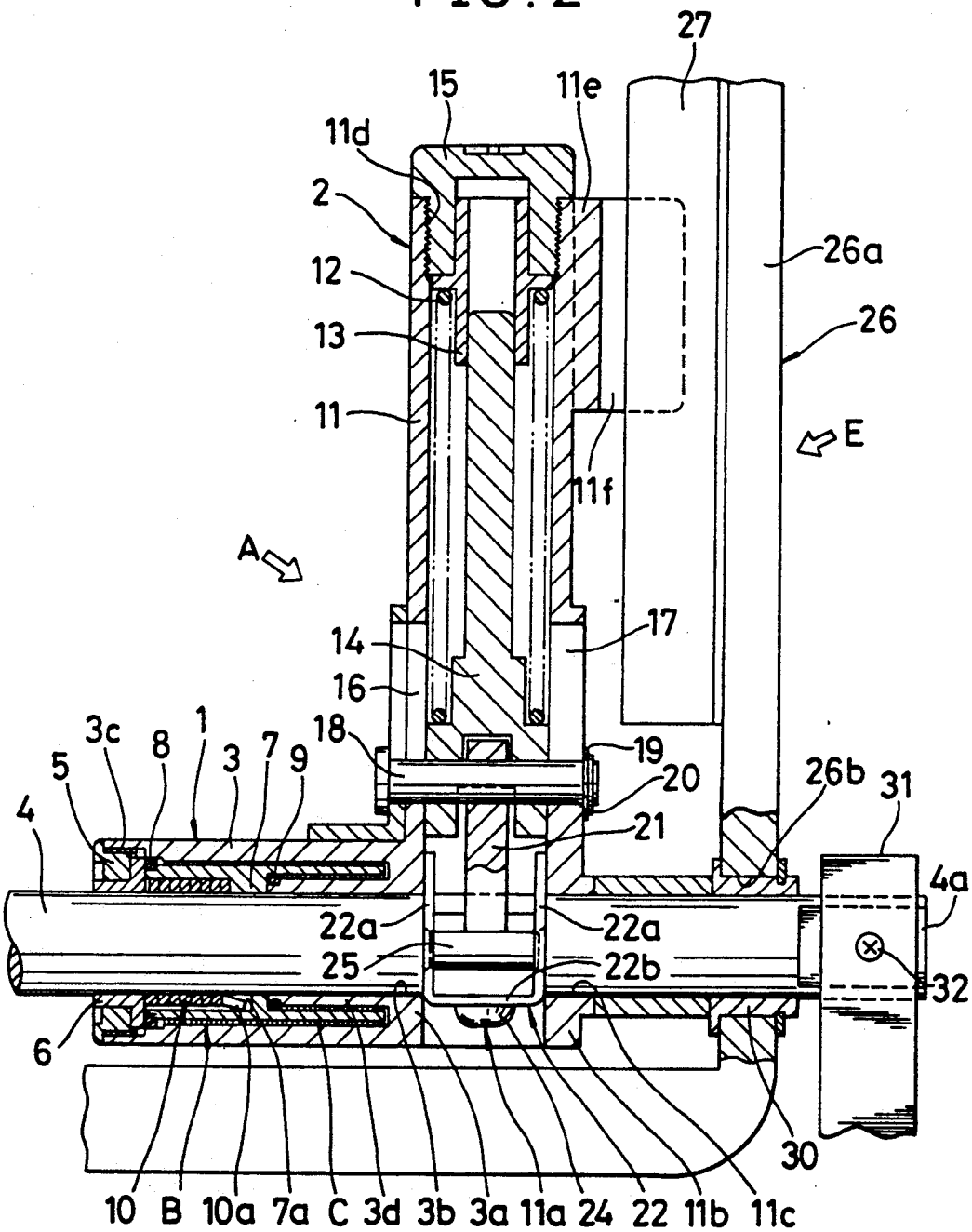
FIG. 2 is a sectional view cut along line II—II of FIG. 1.

Said damper unit 1 comprises a hollow and cylindrical casing 3 rotatable around the fixed shaft 4, a cylindrical and movable sleeve 7 rotatably disposed within said casing 3 and viscous fluid C of a high molecular compound such as polyisobutyne filled in the space between said movable sleeve 7 and the casing 3 and airtightly sealed by the O-rings 8 and 9 as seen from FIG. 2.

Said damper unit 1 has an shaft-receiving opening **3*b* at the center of an end wall 3*a* thereof and a threaded section 3*c* near the other end of the inner periphery of the casing 3. The fixed shaft 4 runs through the opening 3*b* under an airtight condition and, as a lid 5 is driven into said threaded section 3*c*, it also runs through the lid 5 and a bearing 6 disposed inside the lid 5 so that the casing 3 may become rotatable around and axially slidable relative to the fixed shaft 4**.

The movable sleeve 7 which is disposed inside the casing 3 has a length slightly shorter than the effective length of the casing and an outer diameter smaller than the inner diameter of the casing 3, while the inner diameter of a rear half portion of the movable sleeve 7 is greater than the outer diameter of an inner cylindrical section **3*d* of the casing 3 projecting inward from the end wall 3*a* of the casing 3 so that said movable sleeve 7 may be rotatable between the casing 3 and the fixed shaft 4 with the viscous fluid C in the space between the casing 3 and the movable sleeve 7 airtightly sealed by said O-rings 8 and 9 respectively disposed between an end of said movable sleeve 7 and the casing 3 and a middle section of said movable sleeve 7 and the outer open end of said inner cylinder 3*d***.

The damper unit 1 also comprises a one-way clutch 10 constituted by a coil spring disposed between a front half portion of said movable sleeve 7 and the fixed shaft 4 in such a manner that the functional coupling of the casing 3 and the movable sleeve 7 may be released depending on the sense of rotation of the casing 3.

Figure 3:
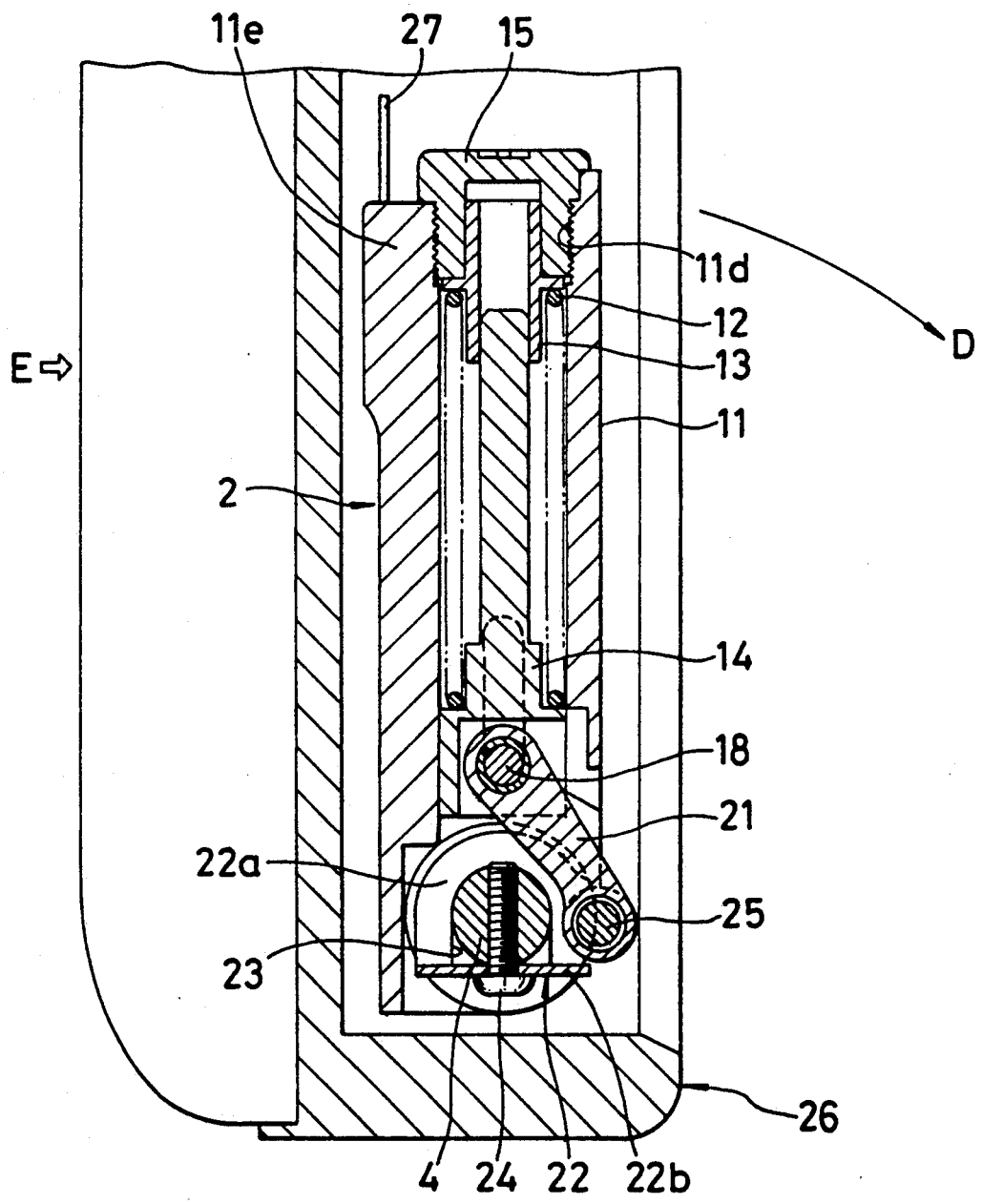
FIG. 3 is a sectional view cut along line III—III of FIG. 1.
Figure 4:
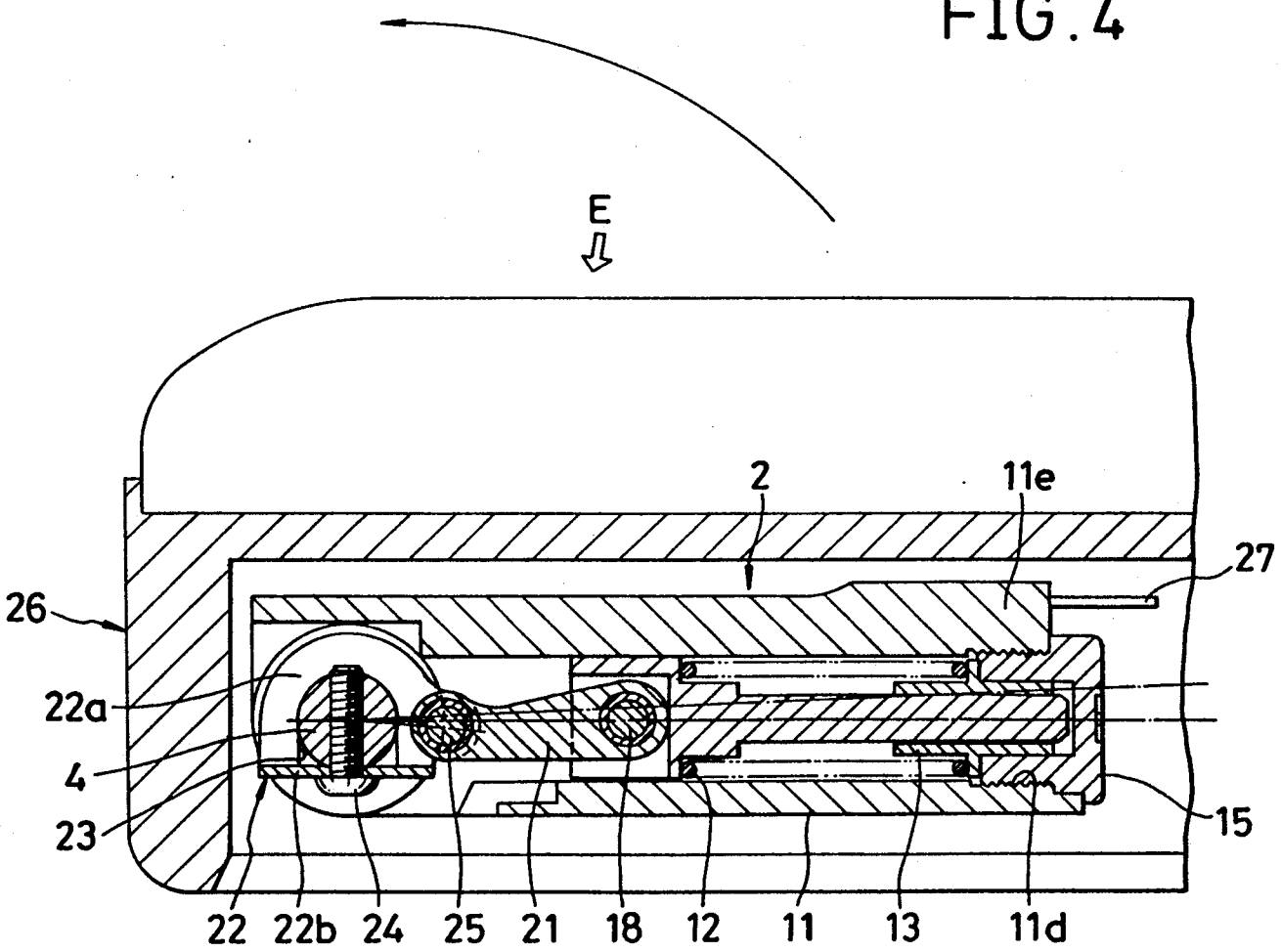
FIG. 4 is a longitudinal sectional view of the embodiment of FIG. 1 when the seat is moved to a ready-for-use position.

As described above, the one-way clutch 10 comprises a coil spring made of a steel wire having a rectangular or circular cross section and wound around the fixed shaft 4 with a relatively high pitch in such a manner that the coil spring may tightly contact the outer peripheral surface of the fixed shaft 4 with an end **10*a* of the wire axially projecting and held in a groove 7*a* of said movable sleeve 7. The other end of the wire of the one-way clutch 10 is left free so that, when the casing 3 is rotated in the sense as indicated by arrow D in FIGS. 1 or 3 or in the direction of turning the seat E to its ready-for-use position, the coil spring is somewhat unwound to enlarge its diameter and consequently release the tight contact between itself and the outer peripheral surface of the fixed shaft 4. As a result, the functional coupling of the fixed shaft 4 and the movable sleeve 7 is released and the latter comes to be rotated with the casing 3** in a same sense to reduce the shearing resistance of the viscous fluid or the damper effect of the device to nil.

When, on the other hand, the casing is rotated in a sense opposite to the above mentioned direction of arrow D or in the direction of turning the seat E to its upright position, the winding of the coil spring of the one-way clutch 10 is tightened to make the coil spring tightly press the outer peripheral surface of the fixed shaft 4 to functionally couple the movable sleeve 7 and the fixed shaft 4 and consequently allow only the casing 3 to rotate in that direction so that the viscous fluid in the space between the casing 3 and the movable sleeve 7 may generate a shearing resistance or the damper effect of the device may become existent.

With such an arrangement of the damper unit 1, when the seat E is pushed down, for example by hand, to turn to its ready-for-use position from the upright position, the one-way clutch 10 is loosened in manner as described above and become freely rotatable relative to the fixed shaft 4 and the movable sleeve 7 is consequently made rotatable relative to the fixed shaft 4 so that the casing 3 and the movable sleeve 7 may synchronously rotate with the viscous fluid C disposed therebetween and the seat E may be lightly and smoothly turned downward as it is free from any shearing resistance of the viscous fluid C.

When the seat E is returned from the ready-for-use position to the upright position by the resilient force of the spring 12 of the power unit 2, which will be described in greater detail later, the force is transmitted from the seat E sequentially to the casing 3, the viscous fluid C, the movable sleeve 7 and the coil spring of the one-way clutch 10 to finally tighten the coil spring and reduce its diameter. As a result, the one-way clutch 10 is firmly held to the fixed shaft 4 to functionally couple the fixed shaft 4 and the movable sleeve 7 and make the latter unrotatable so that the casing 3 is subjected to the viscous shearing resistance of the viscous fluid C and the seat E may only slowly rotate along with the casing 3 to automatically return to its upright position.

As for the power unit 2 of the device, it is also rigidly fitted to the underside of the seat E but perpendicular to the fixed shaft 4 of the chair and comprises a case 11 connected to and standing up from an end of the casing 3, a lower sliding spring stop 14 longitudinally and slidably disposed within said case 11 and a horizontal guide pin 18 fitted to said lower sliding spring stop 14 and running through oppositely disposed vertical guide slots 16 and 17 cut through the respective lateral sides of the case 11 to allow said lower sliding spring stop 14 to move a given stroke. Said guide pin 18 is provided at an end with a head and a stop ring 20 is fitted to the other end of said guide pine 18 with interposition of a washer 19 so that said guide pin 18 may not come out of the guide slots 16 and 17. Under this condition, an arm 21, which will be described below, is pivotally held at its upper end by the guide pin 18 located at the lower end of said lower sliding spring stop 14.

Said power unit 2 also comprises a U-shaped arm support 22 meshed with the fixed shaft 4 at a bottom opening 11*a* of the case and rigidly fitted to said fixed shaft 4 by means of a collar head bolt 24 standing upright. The fixed shaft 4 is run through a pair of holes 23, 23 precisely aligned with each other and cut through the respective lateral walls 22*a*, 22*a* of the arm support 22. Said collar head bolt 24 is driven through the bottom wall 22*b* of the arm support 22. The arm 21 is pivotally supported at its lower end by an axle 25 of the arm support 22 running in parallel with the fixed shaft 4 but displaced outwardly from said holes 23, 23 of the lateral walls 22*a*, 22*a*, while the upper end of said arm 21 is pivotally fitted to said lower sliding spring stop 14 by said guide pin 18 is disposed inside of the case 11.

The case 11 of the power unit 2 is open at the top and has a threaded section 11*d* on an upper most area of its inner peripheral wall. A coil spring 12 is disposed between a lower sliding spring stop 13 longitudinally movably arranged within said case 11 and said lower sliding spring stop 14 with its upper and lower ends abutting the respective stops and an adjustor bolt 15 is driven into the threaded section 11*d* to prevent the upper sliding spring stop 13 from jumping out. Thus, the resilient force of the spring 12 can be adjusted by appropriately modifying the extent of driving the adjuster bolt 15. Reference symbol 11*c* denotes a through bore cut through a lateral wall of the case 11 opposite to the casing 3 in order to receive the fixed shaft 4 so that the case 11 may rotate with the casing 3.

Figure 5:
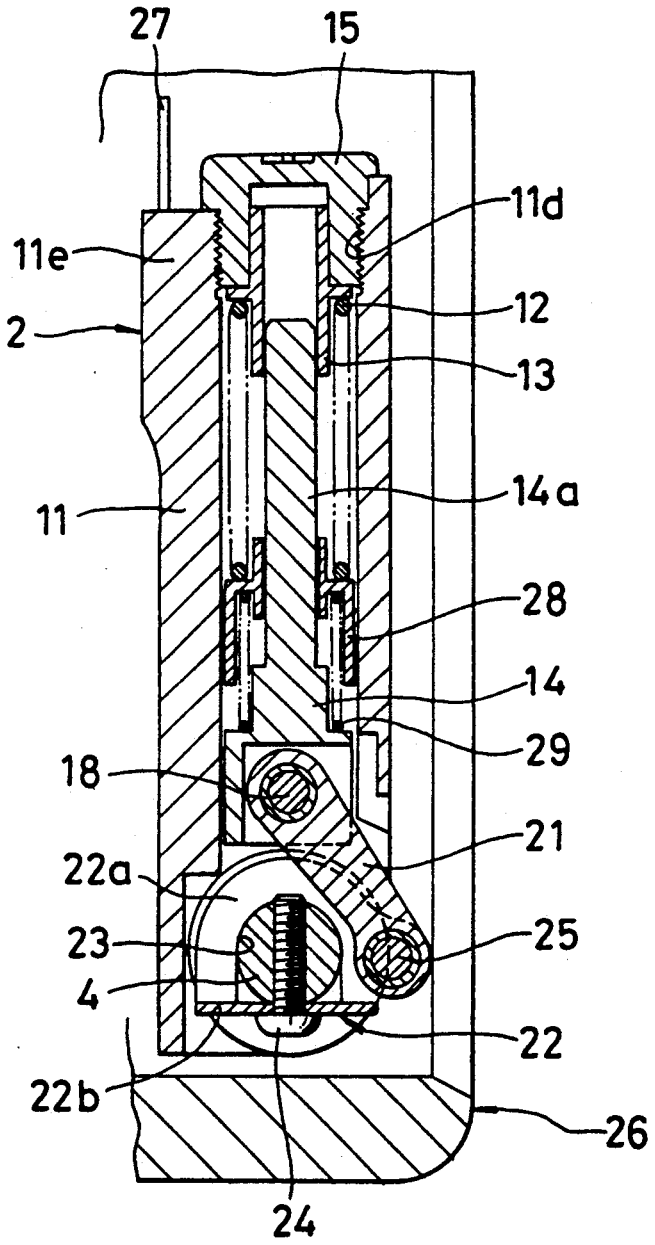
FIG. 5 is a longitudinal sectional view of a second embodiment of the invention.
Figure 6:
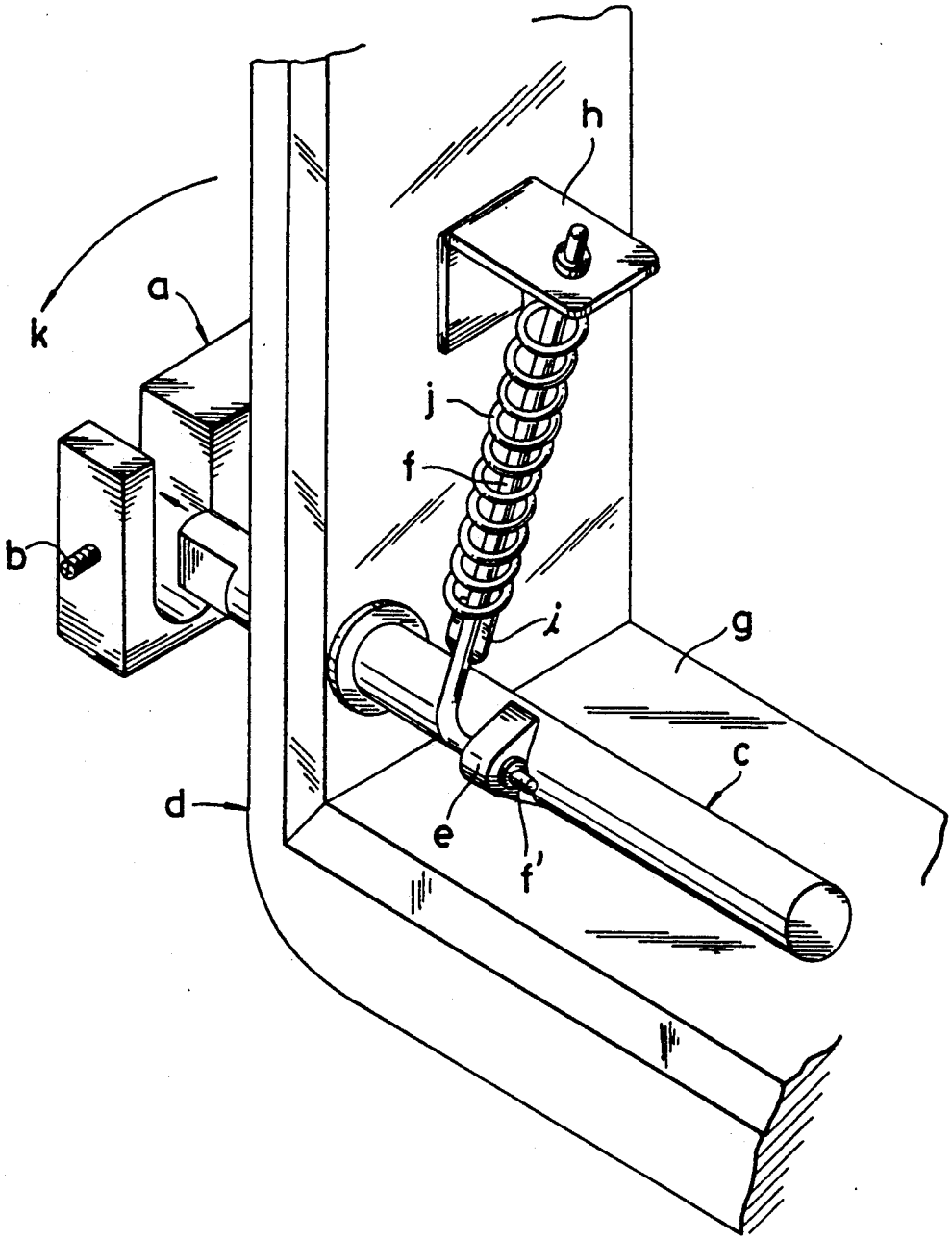
FIG. 6 PRIOR ART
FIG. 6 is a perspective view of a conventional damper device for an automatic folding chair.

For the purpose of the invention, a power unit 2 may alternatively be so designed as illustrated in FIG. 5 where a separate spring stop 28 is longitudinally slidably disposed around a rod-like portion 14*a* of a lower slidable spring stop 14 and a first spring 12 having a greater spring constant and a second spring 29 having a smaller spring constant are respectively arranged between said spring stop 28 and an upper slidable spring stop 13 and between said spring stop 28 and said lower slidable spring stop 14.

With such an arrangement of the components of the spring unit 2, if the resilient force of the spring 12 is so adjusted by an adjuster bolt 15 as to make the swing-up torque of the spring 12 of the seat E smaller than the tangential component of the moment of gravity generated by the dead weight of and applied to the seat E, the chair will be of a so-called self-stop type that can, temporarily, hold the seat E in a ready-for-use position. If, on the other hand, the resilient force of the spring 12 is so adjusted by the adjuster bolt 15 as to make the swing-up torque of the spring 12 of the seat E greater than the tangential component of the moment of gravity of the seat E, then the chair will be of a so-called non-stop type that can automatically and slowly raise the seat E from a ready-for-use position to an upright position.

To embody the third aspect of the invention in this embodiment, the case 11 comprising a projecting portion 11*e* integrally formed with the case 11 and projecting from an upper area of a lateral wall toward a side-member 26*a* of the frame 26 of the seat E. The projecting portion 11*a* is provided with a longitudinal groove 11*f* for receiving a ridge 27, which will be described below, in order to hold the damper device A and the seat E unrotatable with respect to each other around the fixed shaft 4. Said ridge 27 is realized by fitting a flat steel bar perpendicularly to the inner surface of a side-member 26*a* of the frame 26.

For fitting such a damper device A to the fixed shaft 4 of the seat E of an automatic folding chair, the damper device A is held in a standing position in front of the back rest of the chair and the front end 4*a* of the fixed shaft 4 is introduced from through a shaft receiving bore 26*b* of one of the side-members 26*a*, 26*a* of the frame 26 with a bearing 30 interposed therebetween and then through the opening 3*a* of the damper unit 1, the holes 23, 23 of the arm support 22 and the through bore 11*c* of the case 11. Thereafter, the front end of the fixed shaft 4 is made to pass through another shaft receiving bore 26*b* of the other side-member 26*a* of the frame 26. Finally, the both ends of the fixed shaft 4 having respective cut-off areas 4*a*, 4*a* are fitted into respective U-shaped grooves 31*a*, 31*a* of a seat support 31 and grub screws 32, 32 are driven into respective threaded lateral bores 31*b*, 31*b* of the seat support 31 until the front ends of the screws are firmly pressed against the respective cut-off areas 4*a*, 4*a* to securely hold the fixed shaft 4 to the seat support 31.

Then, the damper device A is slidingly moved on the fixed shaft 4 toward said other side-member 26 of the seat E until the ridge 27 of the frame 26 is pushed into the groove 11*f* of the case 11, when the arm support 22 is firmly held to the fixed shaft 4 by the collar head bolt 24 to make the damper device A rotate with respect to with the fixed shaft 4. Now the damper device A is completely fitted to the seat E.

As described above, when fitted to a seat of an automatic folding chair, a damper device according to the first aspect of the present invention allows the seat to be lightly and smoothly turned downward by hand from an upright position to a ready-for-use position without any braking force exerted thereto so that the seat of the chair can be moved down quickly with very little effort to make itself ready for use.

When the user of the chair leaves it, the seat automatically and slowly rises up, minimizing the noise and impact generated by the upward movement of the seat to become nuisance to persons sitting next to or near the seat as well as the danger that can be caused by an abrupt rising movement of a seat. Additionally, since the damper unit of the device disposed around a fixed shaft is of a very small size, the overall dimensions of the chair may be significantly reduced whenever necessary.

A so-called self-stop type chair having a seat that can be held to a ready-for-use position or a so-called non-stop type chair having a seat that can automatically rise from a ready-for-use position to an upright position can be realized by using a damper device for an automatic folding chair according to the second aspect of the present invention and adjusting the resilient force of the spring of its power unit by means of an adjuster screw fitted thereto.

Since a damper device for an automatic folding chair according to the third aspect of the present invention comprises a power unit for automatically driving the seat upward and a damper unit for damping the upward movement of the seat are integrally formed, it can be fitted to the underside of a seat by simply introducing a fixed shaft there through and rigidly securing it to the seat. The seat and the device can be made to rotate synchronously by simply introducing the ridge of the seat into the groove of the device and firmly held together for axial movement by securing the arm support to the fixed shaft by means of a collar head bolt so that the entire device may be mounted to and removed from a seat without requiring any cumbersome operations. Thus, the device can be serviced with utmost ease. Finally, since no complicated operations for connecting the components are involved, the device can be manufactured at reduced cost. An automatic folding chair provided with such a damper device is free from impact even when the seat is abruptly raised by force.

What is claimed is:

1. A damper device for an automatic folding seat chair comprising a power unit for storing a resilient force generated in a spring means by rotary movement of the seat from a substantially upright standing position to a substantially horizontal ready-for-use position and a damper unit for damping the returning movement of the seat to the substantially upright position, said damper unit comprising a casing rotatable around a fixed shaft in synchronism with an upward or downward movement of the seat, a movable sleeve rotatably disposed within said casing, viscous fluid filled in a space between said movable sleeve and said casing and a one-way clutch constituted by a coil spring disposed between said movable sleeve and said fixed shaft in such a manner that the coil spring diameter is enlarged to release a functional coupling of the movable sleeve and the fixed shaft when the seat is turned downward and reduced to provide a functional coupling of the movable sleeve and the fixed shaft when the seat is turned upward.

2. A damper device for an automatic folding seat comprising a power unit for storing a resilient force generated in a spring means by rotary movement of the seat from a substantially upright standing position to a substantially horizontal ready-for-use position and a damper unit for damping the returning movement of the seat to the substantially upright position, said damper unit comprising a casing rotatable around a fixed shaft in synchronism with an upward or downward movement of the seat, a movable sleeve rotatably disposed within said casing, viscous fluid filled in a space between said movable sleeve and said casing and a one-way clutch constituted by a coil spring disposed between said movable sleeve and said fixed shaft in such a manner that the coil spring diameter is enlarged to release a functional coupling of the movable sleeve and the fixed shaft when the seat is turned downward and reduced to provide a functional coupling of the movable sleeve and the fixed shaft when the seat is turned upward, said power unit comprising a case projecting from the casing of said damper unit perpendicularly to an axis of said casing, a lower sliding spring stop disposed within said case and guided by a guide pin running through a pair of guide slots cut through oppositely disposed respective lateral side walls of said case so as to be able to move a given stroke, a crank mechanism having an arm with an end pivotally supported by said guide pin and held to said lower sliding spring stop and another end pivotally supported by an axle of an arm support eccentrically and rigidly fitted to the fixed shaft, an adjuster screw driven through a threaded bore disposed at a top portion of the case, an upper sliding spring stop capable of being positionally adjusted by said adjuster screw and a spring disposed between said upper sliding spring stop and said lower sliding spring stop to exert a resilient force to the seat to urge it to rotate upward.

3. A damper device for an automatic folding seat comprising a power unit for storing a resilient force generated in a spring means by rotary movement of the seat from a substantially upright standing position to a substantially horizontal ready-for-use position and a damper unit for damping the returning movement of the seat to the substantially upright position, said damper unit comprising a casing rotatable around a fixed shaft in synchronism with an upward or downward movement of the seat, a movable sleeve rotatably disposed within said casing, viscous fluid filled in a space between said movable sleeve and said casing and a one-way clutch constituted by a coil spring disposed between said movable sleeve and said fixed shaft in such a manner that the coil spring diameter is enlarged to release a functional coupling of the movable sleeve and the fixed shaft when the seat is turned downward and reduced to provide a functional coupling of the movable sleeve and the fixed shaft when the seat is turned upward, said power unit comprising a case projecting from the casing of said damper unit perpendicularly to an axis of said casing, a lower sliding spring top disposed within said case and guided by a guide pin running through a pair of guide slots cut through oppositely disposed respective lateral side walls of said case so as to be able to move a given stroke, a crank mechanism having an arm with an end pivotally supported by said guide pin and held to said lower sliding spring stop and another end pivotally supported by an axle of an arm support eccentrically and rigidly fitted to the fixed shaft, an adjuster screw driven through a threaded bore disposed at a top portion of the case, an upper sliding spring stop capable of being positionally adjusted by said adjuster screw and a spring disposed between said upper sliding spring stop and said lower sliding spring stop to exert a resilient force to the seat to urge it to rotate upward, a ridge and a groove being provided additionally and respectively on an outer surface of the case of said power unit and the seat or vice versa, said ridge and said groove being capable of being removably engaged with each other to block any rotary movement relative to each other by relative movement along an axis of the fixed shaft.

* * * * *